US009737736B2

(12) United States Patent
Boothby et al.

(10) Patent No.: US 9,737,736 B2
(45) Date of Patent: Aug. 22, 2017

(54) FALL ARREST HARNESS

(71) Applicant: CMC Rescue, Inc., Goleta, CA (US)

(72) Inventors: Stephen Boothby, Montecito, CA (US); Joseph Flachman, Santa Barbara, CA (US)

(73) Assignee: CMC Rescue, Inc., Goleta, CA (US)

( * ) Notice: Subject to any disclaimer, the term of this patent is extended or adjusted under 35 U.S.C. 154(b) by 0 days.

(21) Appl. No.: 14/986,285

(22) Filed: Dec. 31, 2015

(65) Prior Publication Data

US 2016/0206903 A1 Jul. 21, 2016

Related U.S. Application Data

(60) Provisional application No. 62/104,016, filed on Jan. 15, 2015.

(51) Int. Cl.
*A62B 35/00* (2006.01)

(52) U.S. Cl.
CPC ..... *A62B 35/0018* (2013.01); *A62B 35/0037* (2013.01)

(58) Field of Classification Search
CPC ..... A62B 35/0018; A62B 35/0037
See application file for complete search history.

(56) References Cited

U.S. PATENT DOCUMENTS

| | | | | |
|---|---|---|---|---|
| 6,101,631 | A * | 8/2000 | Ferguson, Jr. | A41D 13/0007 182/3 |
| 6,367,582 | B1 * | 4/2002 | Derby | A62B 35/0018 119/857 |
| 6,367,583 | B1 * | 4/2002 | Derby | A62B 35/0018 119/857 |
| 7,779,484 | B2 * | 8/2010 | Fee | A62B 17/003 2/69 |
| 9,162,089 | B2 * | 10/2015 | Harshbarger | A62B 35/00 |
| 2006/0113147 | A1 | 6/2006 | Harris, Jr. | |
| 2008/0060872 | A1 | 3/2008 | Wise | |
| 2010/0252361 | A1 | 10/2010 | Wood | |
| 2011/0168488 | A1 | 7/2011 | Simard et al. | |

OTHER PUBLICATIONS

International Search Report and Written Opinion issued in International Application No. PCT/US2016/012385; date of mailing Mar. 16, 2016; 7 pages.

* cited by examiner

*Primary Examiner* — Alvin Chin-Shue
(74) *Attorney, Agent, or Firm* — McCoy Russell LLP

(57) ABSTRACT

A fall arrest harness having a primary arrest attachment attached to a dorsal portion of a harness by a dorsal release strap, a releasable friction device positioned at a hip location of the harness and a repositioning tether releasably connected to the primary fall arrest attachment. The harness provides manual and controllable transfer of a suspension point from a dorsal location by letting out the dorsal release strap through the releasable friction device until tension from a user's weight is transferred from the dorsal release strap to the repositioning tether.

16 Claims, 3 Drawing Sheets

FALL ARREST HARNESS

CROSS-REFERENCE TO RELATED APPLICATION(S)

This application claims the benefit of and priority to U.S. Provisional Application No. 62/104,016 filed Jan. 15, 2015, the entire contents of which are incorporated herein by reference

BACKGROUND OF THE INVENTION

The invention relates generally to safety harnesses, and in particular to harnesses used for fall arrest. The current state of the art in fall arrest harnesses utilizes a primary fall arrest attachment point at the dorsal location. The dorsal location provides for optimal transfer of energy during the arrest of the falling person and is the required location for the primary fall arrest attachment point in several industry standards governing the typical user of a fall arrest harness.

A significant negative side effect of arresting a fall from the dorsal location is the difficulty of self-rescue. The inability to reach and manipulate a loaded dorsal attachment point necessitates rescue of the fallen worker by others. Any delay in rescue can lead to medical complications from the suspension from the dorsal location, which on some occasions has occurred in a manner of minutes depending on the worker and the design of the harness worn. The ability to transfer the suspension point from the dorsal location to a more advantageous location is therefore desirable. Previous designs have allowed for either automatic or manual transfer of the suspension point, but the transfer was not controllable. An automatic transfer can, depending on the deployment, result in arresting the fall in an undesirable location with potentially harmful energy transfer. A manual transfer, if uncontrolled, can result in a secondary fall and arrest with additional forces to the body. Consequently, a need exists for an improved fall arrest harness design that addresses the drawbacks of prior harnesses.

SUMMARY OF THE INVENTION

The present invention is directed to a fall arrest harness and method of manually and controllably transferring the suspension point from a dorsal location to a more advantageous location. This harness and method ensures an initial arrest at the dorsal location for optimal transfer of energy into the body, and a smooth transfer of suspension without a secondary fall and arrest. The method may be one of several designs, and may be easily accessed and operated by the user of the harness. The harness comprises left and right shoulder sections, left and right leg sections, a chest section, buttocks section and a dorsal release strap. The harness further includes a repositioning tether which connects a fall arrest attachment point to a secondary location at the front of the harness.

A function of the present invention is to provide a controllable means of transferring the suspension point from the dorsal location to a more advantageous location in order to relieve the conditions leading to potential medical complications until rescue of the fallen person can be affected.

DESCRIPTION OF THE PREFERRED EMBODIMENT

Figure 1:
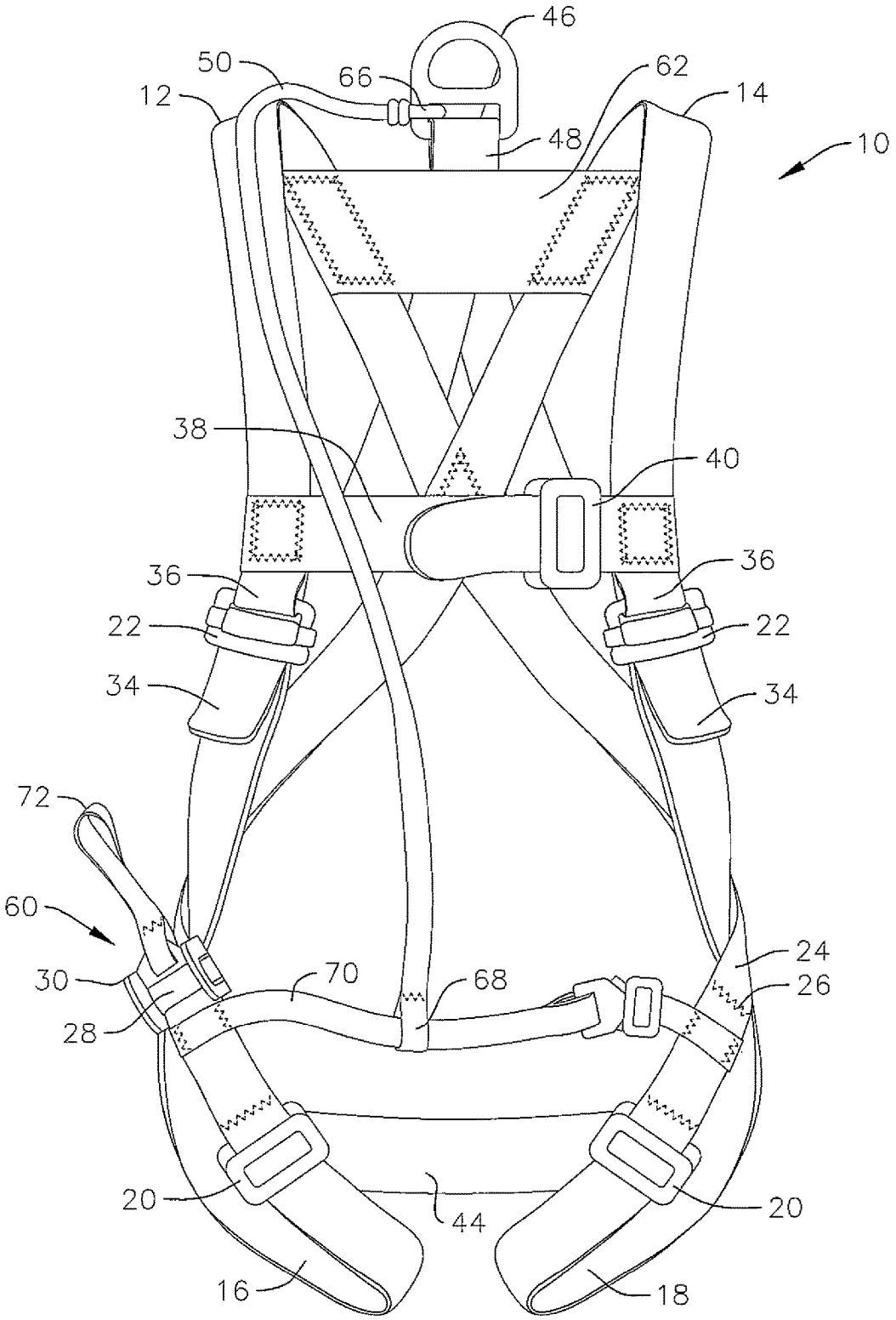
FIG. 1 is a front view of a fall arrest harness of the present invention.
Figure 2:
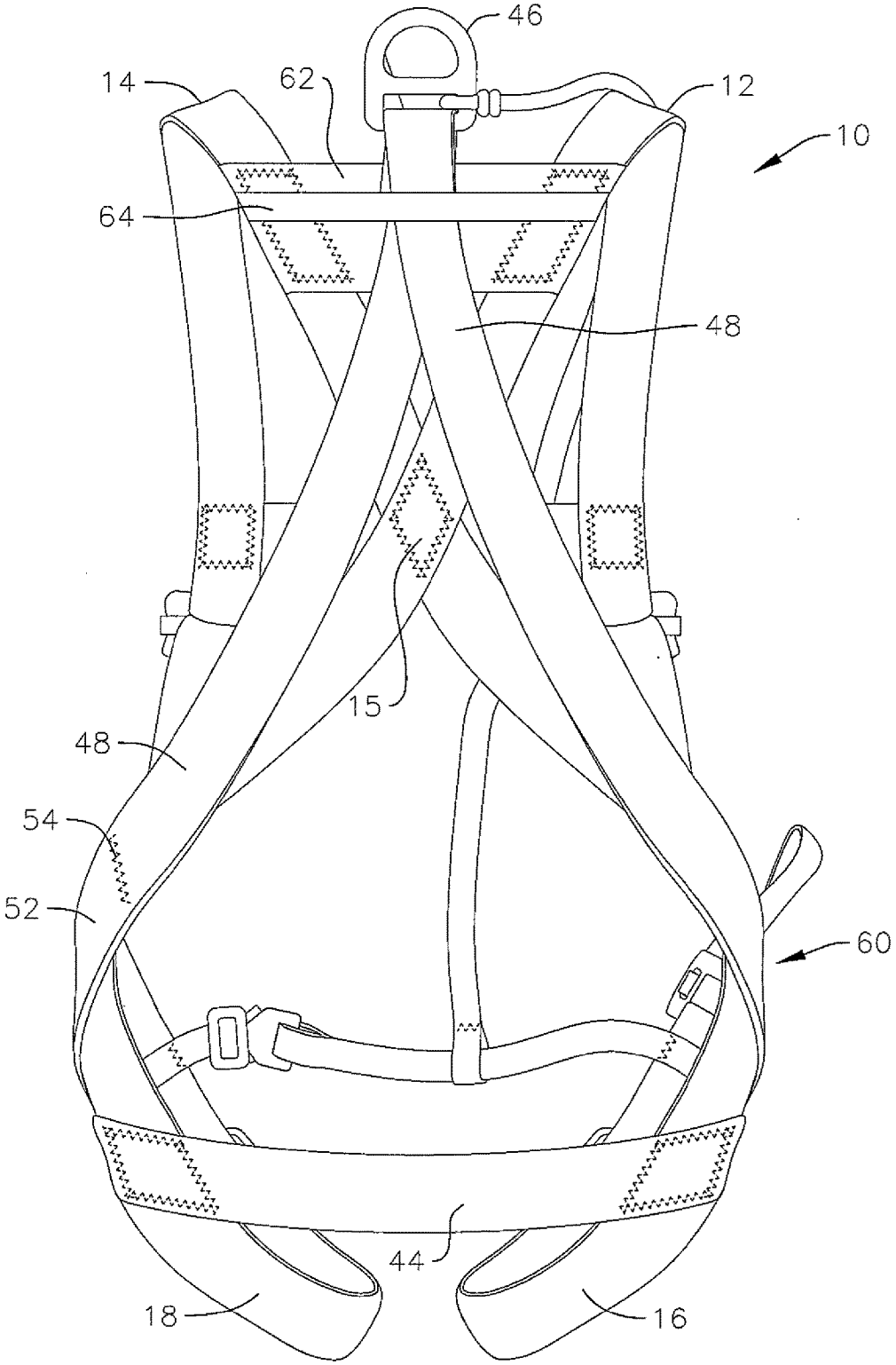
FIG. 2 is a rear view of the fall arrest harness of FIG. 1.

In FIGS. 1 and 2, one embodiment of a fall arrest harness 10 of the present invention is illustrated. The harness 10 is typically made from webbing, which is a woven fabric having multiple sections. Other materials can also be utilized. The harness includes a right shoulder section 12, a left shoulder section 14, each of the shoulder sections extend over the chest and abdomen of the wearer in the front and over the shoulder and down the back of the wearer in a crossing fashion and are stitched together 15. The harness further includes webbing for a looped right leg section 16 and a left leg section 18. Each of the leg sections may pass through a friction device or buckle 20 positioned thereon. Each of the leg sections may, for example, have a segment 24 of strapping sewn by stitching 26 onto the strapping to form a loop through which the webbing passes to maintain the loop configuration of the leg sections, although other configurations are possible. An end 28 of the right leg section is looped through and connects to friction device 30. Ends 34 of the leg sections loop through and attach to buckles 22. Ends 36 of the shoulder sections also attach to buckle 22.

The harness 10 further includes a chest section 38 which extends through a buckle 40 for tightening the chest section around the wearer. The ends of the chest section 38 are sewn onto the shoulder section strapping. The harness further includes a sub-pelvic strap 44 which is a segment of strapping sewn to each of the leg sections. The harness further includes a primary fall arrest attachment point 46 which is attached to the harness 10 via a dorsal release strap 48 and a repositioning tether 50. For example, attachment point 46 may be a D-ring.

In a first embodiment shown in FIG. 2 the dorsal release strap 48 is fixed at one end 52 to the harness at the hip by being sewn 54 to the leg section. The dorsal release strap passes through the attachment point 46 at the dorsal location and then downwardly through the friction device 30 at an opposite hip location 60. The dorsal release strap is retained in a dorsal position by a guide webbing 62 and guide strap 64 sewn to guide webbing 62. The dorsal release strap extends between the guide webbing 62 and guide strap 64.

Figure 3:
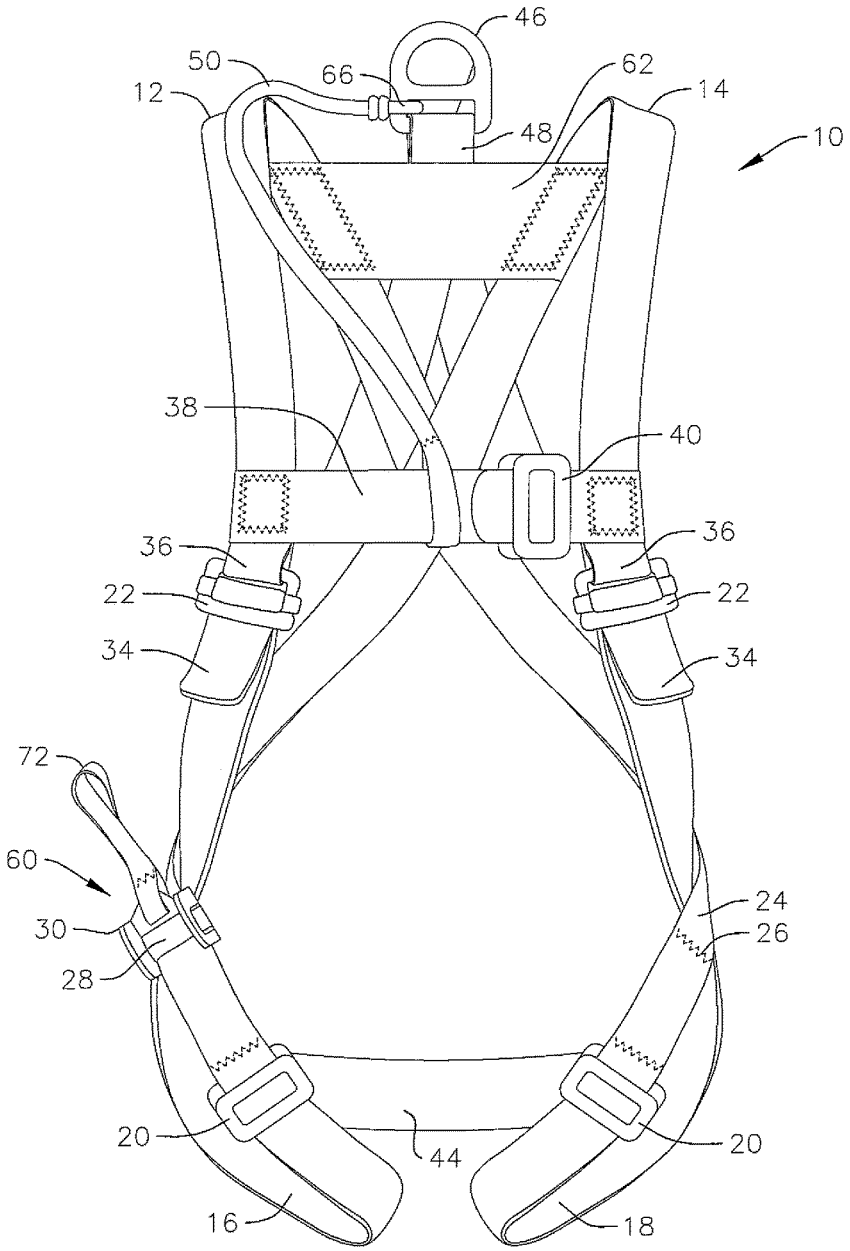
FIG. 3 is a front view of an alternative embodiment fall arrest harness of the present invention.

The repositioning tether 50 is affixed to the attachment point 46 at one end 66 and at an opposite end 68 to the front of the harness by either a waist strap 70 as shown in FIG. 1 or by being connected to chest strap 38 as shown in FIG. 3. A snap link or other similar connector (not shown) connects the harness to an appropriate anchorage via the releasable fall arrest attachment point 46.

The dorsal release strap 48 has sufficient length (tail) to allow the strap to be let out through the friction device 30 until the tension from the user's weight has been transferred from the dorsal release strap to the repositioning tether 50 thus preventing any free and unrestricted movement of the dorsal release strap and thereby preventing a secondary fall and arrest.

Transfer of the suspension point is accomplished by the user manipulating the friction device 30 at the hip location by pulling on strap 72. This location provides the user optimal leverage for manipulating the friction device, even if injured in the initial fall. The design of the friction device

30 allows the user to progressively reduce the friction on the dorsal release strap by pulling on strap 76 which disengages the friction device thereby controlling the rate at which the transfer is affected. Once the tension of the user's weight has been transferred to the repositioning tether 50, the user can manually feed the remaining tail of the dorsal release strap through the friction device. This allows a full release of the primary fall arrest attachment point 46 from the dorsal location of the harness, completely transferring the suspension of the user to the more advantageous location.

Although the present invention has been disclosed with respect to embodiments thereof, it is to be understood that changes and modifications can be made therein which are within the intended scope of the invention as hereinafter claimed.

What is claimed is:

1. A fall arrest harness comprising:

a harness having a primary fall arrest attachment attached to a dorsal portion of the harness by a dorsal release strap;

a releasable friction device positioned on the dorsal release strap, wherein the dorsal release strap extends from a first side of the harness through the primary fall arrest attachment and then through the releasable friction device, which is also fixed to the harness, the dorsal release strap fixed to only one side of a hip location, wherein the releasable friction device includes a strap for manual manipulation of the releasable friction device; and a repositioning tether connected to the primary fall arrest attachment, wherein the repositioning tether has an opposite end attached to a front strap on the harness, and where the dorsal release strap is uncoupled from the releasable friction device when the manipulation strap is pulled and lets the dorsal release strap through the releasable friction device to transfer weight onto the repositioning tether.

2. The harness of claim 1, further comprising:

a left shoulder section;

a right shoulder section;

a left leg section;

a right leg section; and a chest section.

3. The harness of claim 1, wherein the primary fall arrest attachment is a rigid attachment point.

4. The harness of claim 1, wherein the front strap is a waist strap.

5. The harness of claim 1, wherein the releasable friction device is positioned at a hip location of the harness and is physically coupled to the harness at a second side opposite the first side.

6. The harness of claim 1, wherein the front strap is a chest strap.

7. The harness of claim 1, wherein the repositioning tether has an opposite end attached to a waist strap on the harness.

8. The harness of claim 1, wherein transferring weight onto the repositioning tether prevents a secondary fall following an initial fall.

9. A fall arrest harness having shoulder and leg strapping, further comprising:

a dorsal fall arrest attachment;

a dorsal release strap attached to the dorsal fall arrest attachment, wherein the dorsal release strap extends from one side of the harness through the dorsal fall arrest attachment and then through a releasable friction device on an opposite side of the harness, the dorsal release strap fixed to only one side of a hip location;

a repositioning tether connected to the dorsal fall arrest attachment, where the repositioning tether has an opposite end attached to a waist strap on the harness; and means for manually transferring the dorsal fall arrest attachment from a dorsal location to another location, wherein the means further includes where the releasable friction device includes a strap for manual manipulation of the releasable friction device, and where the dorsal release strap is uncoupled from the releasable friction device when the manipulation strap is pulled and lets the dorsal release strap through the releasable friction device to gradually transfer weight onto the repositioning tether.

10. The harness of claim 9, wherein the dorsal fall arrest attachment is a ring.

11. The harness of claim 9, wherein the dorsal fall arrest attachment is a rigid attachment point.

12. The harness of claim 9, wherein the dorsal release strap is sewn to the hip location.

13. The harness of claim 9, wherein the releasable friction device is positioned at a hip location of the harness opposite the hip location to which the dorsal release strap is fixed.

14. The harness of claim 9, wherein the dorsal release strap is positioned by a guide brace.

15. The harness of claim 14, wherein the guide brace is coupled to left and right shoulder sections of the harness.

16. The harness of claim 9, wherein transferring weight from the dorsal release strap to the repositioning tether prevents a secondary fall following an initial fall.

* * * * *